United States Patent [19]

Jennings et al.

[11] Patent Number: 4,621,682

[45] Date of Patent: Nov. 11, 1986

[54] TUBE SUPPORT ASSEMBLY FOR A HEAT EXCHANGER

[75] Inventors: William B. Jennings, Collierville, Tenn.; Robert M. Kozlowski, Syracuse; Richmond S. Hayes, Jr., Fayetteville, both of N.Y.

[73] Assignee: Carrier Corporation, Syracuse, N.Y.

[21] Appl. No.: 645,900

[22] Filed: Oct. 31, 1984

Related U.S. Application Data

[62] Division of Ser. No. 450,705, Dec. 17, 1982, Pat. No. 4,492,269.

[51] Int. Cl.[4] ..... F28F 9/00; F28D 1/04; F28D 7/04; F25B 39/04

[52] U.S. Cl. ..... 165/76; 165/172; 248/68.1

[58] Field of Search ..... 248/68.1; 165/172, 76, 165/67, 68, 125, 162; 62/291, 263

[56] References Cited

U.S. PATENT DOCUMENTS

| | | | |
|---|---|---|---|
| 2,026,312 | 12/1935 | Houts | 248/68.1 |
| 3,544,049 | 12/1970 | Brown | 248/68.1 |
| 3,677,339 | 7/1972 | Perrin et al. | 248/68.1 |
| 4,076,199 | 2/1978 | Paulsen | 248/68.1 |
| 4,231,421 | 11/1980 | Eaton | 165/76 |
| 4,244,542 | 1/1981 | Mathews | 248/68.1 |
| 4,321,803 | 3/1982 | Smith | 165/76 |
| 4,344,478 | 8/1982 | Petaja et al. | 165/76 |
| 4,380,263 | 4/1983 | Wright | 165/76 |
| 4,401,156 | 8/1983 | Wojtecki et al. | 248/68.1 |

*Primary Examiner*—Albert W. Davis, Jr.
*Assistant Examiner*—John K. Ford
*Attorney, Agent, or Firm*—David J. Zobkiw

[57] ABSTRACT

Apparatus for use in a heat exchange unit having wound fin tubing including a tube support assembly having a tube support and a rod for securing runs of wound fin tubing therebetween. The rod is mounted to the tube support in rod slots providing a snap fit arrangement. The entire tube support assembly is designed for use for mounting a peripherally encasing heat exchanger that is tapered to a vertical partition.

6 Claims, 5 Drawing Figures

TUBE SUPPORT ASSEMBLY FOR A HEAT EXCHANGER

This application is a division of application Ser. No. 450,705 filed Dec. 17, 1982 now U.S. Pat. No. 4,492,269.

BACKGROUND OF THE INVENTION

1. Field of the Invention

The present invention relates to a heat exchanger assembly. More specifically, the present invention relates to a combination tube support assembly including a support member having various portions and a tubular support means which may be secured to the support member utilizing a snap fit such that wound fin tubing is maintained in a preselected position as well as providing structural support for a heat exchanger.

2. Prior Art

Wound fin heat exchangers are well known in the refrigeration and air conditioning fields. A wound fin heat exchanger consists of a tube having a fin material wrapped about the tube in heat exchange relation therewith to promote heat transfer between the fluid flowing through the tube and a separate fluid flowing over the tube. Utilization of this type of heat exchanger has been found to be both cost effective and to provide the appropriate heat transfer surface with a minimum of tube length. A type of wound fin tubing includes slit fin tubing wherein a sheet of fin material is slit laterally and then rolled to a generally U-shaped arrangement such that the non-slit portion is wound against the tube and the slit portions extend outwardly therefrom.

To make advantageous use of wound fin heat exchangers it is necessary that the heat exchanger be configured to optimize heat transfer. Once the appropriate configuration is ascertained, the wound fin tubing should then be maintained in that configuration for the life of the heat exchanger. There have been several methods used for mechanically securing loops of wound fin tubing comprising a heat exchanger. Heretofore used methods in the air conditioning industry for securing adjacent loops of a wound fin heat exchanger include using adhesives or mechanically deforming the coil beyond the point of elasticity such that a new configuration is maintained.

Another method of securing the loops of wound fin tubing is to provide a support means including loop receiving portions for receiving the wound fin tubing and a tubular support secured through openings in extensions from the support means to secure the runs of tubing between the tubular support and the support means. One of the disadvantages of this arrangement is that the tube must be inserted through the openings in all of the extensions to secure the runs of tubing. This results in more damage than necessary to the wound fin heat transfer surface.

Additionally, this prior art tube support was designed to be mounted in a vertical arrangement to provide structural support for a unit. The extensions all extended horizontally and provided openings such that the tube would extend vertically and be engaged at each end to a structural portion of the heat exchange unit. The herein support assembly is designed to be mounted generally at an angle inclined slightly from the main axis of the heat exchanger. Additionally, the tubular support member is sized and the extension portions are arranged such that rod receiving slots are provided to receive the tubular support in a snap fit arrangement such that the rod may be snapped into position to secure the runs of wound fin tubing with a minimum displacement of the wound fin heat transfer surface. Additionally, the tube support as disclosed herein is designed to be mounted to a vertical partition such that an end of the tube support and a tubular support means are angled to mate normal to the vertical partition while the remainder of the support and of the rod are bent to the appropriate tapered angle desired for the heat exchanger. Consequently, the tubular support means is inserted through the fixed opening at one angle and the bent portion is snapped into extension portions to secure same for maintaining the runs of wound fin tubing appropriately positioned between the tubular support means and the support member.

SUMMARY OF THE INVENTION

It is an object of the present invention to provide apparatus for supporting wound fin tubing in an appropriate configuration to serve as a heat exchanger.

It is another object of the present invention to provide a support for a heat exchanger assembly which simultaneously maintains a wound fin coil in the appropriate configuration.

It is a further object of the present invention to provide apparatus for securing wound fin tubing as a part of a heat exchanger assembly which is easy to manufacture and convenient to assemble.

It is yet another object of the present invention to provide a tube support for use with a wound fin heat exchanger wherein tubular support means may be snapped into position to secure runs of wound fin tubing.

It is a further object of the present invention to provide a tube support which may be mounted in a generally horizontal manner for securing runs of wound fin tubing.

It is a still further object of the present invention to provide a combination support member and tubular support means wherein the support member and the tubular support means are both angled such that the combination may be secured to a vertical member while the heat exchanger maintained within the tube support is angled from the horizontal such that a tapered heat exchanger is provided.

It is yet another object of the present invention to provide a support member appropriately angled to prevent rotation of the support member upon assembly to a vertical partition.

It is a further object of the present invention to provide a safe, economical, reliable and easy to install and manufacture support for use with wound fin tubing in the heat exchange unit.

Other objects will be apparent from the description to follow and the appended claims.

The above objects are achieved according to the preferred embodiment of the invention by the provision of a heat exchanger assembly which includes a heat exchanger formed from a plurality of loops of wound fin tubing including a projecting fin material extending from a base tube, said loops being located in a circumferentially extending pattern wherein adjacent loops are displaced relative to each other to provide a tapered configuration. At least one tube support assembly for securing the loops in the tapered configuration including a support member having tube securing portions which define tube receiving openings for the receipt of the individual loops of tubing is further disclosed. An extension portion projects beyond the tube securing portion and defines a rod slot. A rod extending the length of the support member and being sized to snap fit into and be secured within the rod slot of the extension portion is further disclosed, said rod securing the loops of tubing in the tube receiving opening by engaging the loops on the opposite side from the tube support.

A tube support assembly for securing loops of wound fin tubing in an inclined configuration is further disclosed. The support member includes a back portion extending at an inclined angle from horizontal and having a partition end portion defining an opening and at least one extension portion defining a rod slot, said portions extending upwardly from the back portion. A tubular support means sized to extend through the opening in the partition end portion and to snap fit into the rod slot of the extension portion is further disclosed, said tubular support means acting to secure the loops of tubing between the tubular support means and the support member.

DESCRIPTION OF THE PREFERRED EMBODIMENT

The embodiment as described herein is adapted for use in a vertically mounted packaged heat pump as may be used to provide conditioned air to an apartment, condominium or similar structure. The unit is designed to be mounted having an outdoor section extending in communication with outdoor ambient air and an indoor section for delivering conditioned air to the enclosure. The tube support and heat exchanger assembly as claimed herein are directed to a heat exchanger which is formed in a circumferentially extending configuration and being tapered inwardly as it extends from the partition outwardly such that the largest loops of tubing of the heat exchanger are located towards the partition and the smallest loops at the exterior edge of the heat exchanger. The support assembly is designed to be located to extend at a small angle to a horizontal plane and to be connected to a vertically extending partition. It is to be understood that the invention as claimed herein is likewise suitable for other types of applications and to heat exchangers arranged in various configurations having varying amounts of tapers and of different circumferential and depth configurations as well as varying numbers of rows of tubing. This support assembly is likewise appropriate for use in not only securing the heat exchanger in the desired position but additionally providing structural support for other components within the heat exchange unit.

Figure 1:
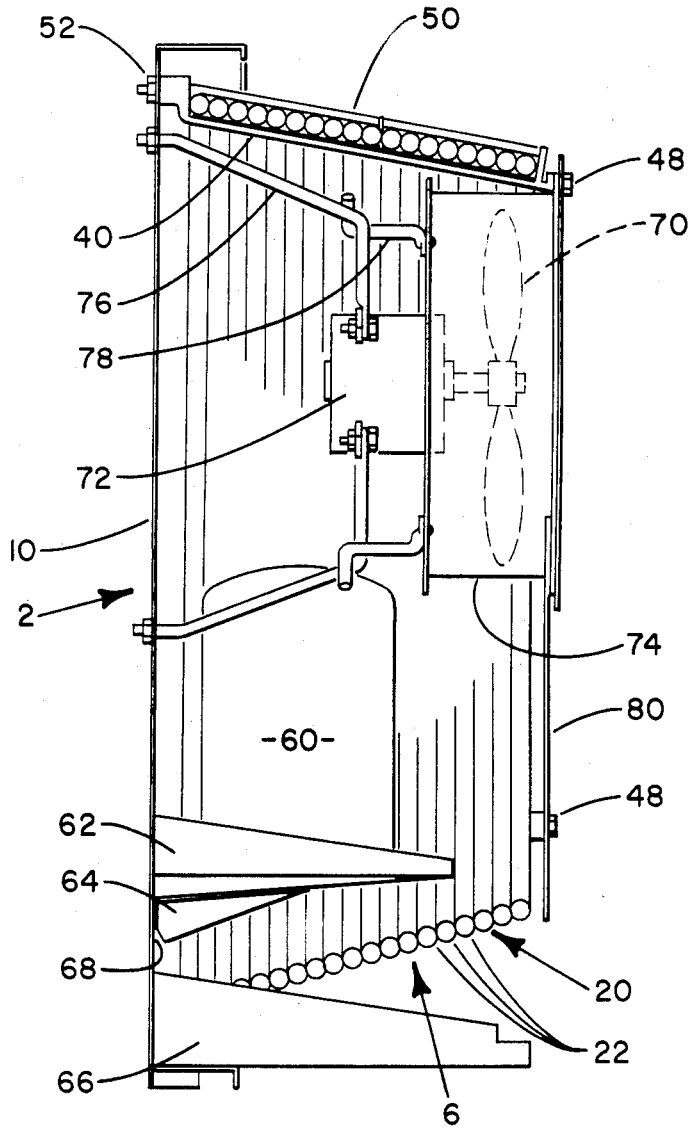
FIG. 1 is a partially cutaway side view of the outdoor section of a vertically mounted packaged air conditioning unit.

Referring to FIG. 1 there may be seen the outdoor portion of a vertically mounted packaged air conditioning unit. Partition 10 is a vertically extending support member which defines the boundary between outdoor section 6 of unit 2 and the indoor section (not shown). Heat exchanger 20 is shown mounted within the outdoor section and has compressor 60 and outdoor fan 70 mounted therewithin. Fan motor support legs 76 are shown secured to fan motor 72 to maintain the fan motor in position relative to partition 10. Fan orifice support 78 further connects fan orifice 74 to fan motor support leg 76 to maintain the fan orifice in position. Tube support 40 is shown at the top of the unit having heat exchanger 20 located between tube support 40 and rod 50. Additionally, it can be seen that nut 52 engaged to rod 50 acts to secure the tube support to the partition.

Compressor 60 of the refrigeration circuit is mounted on compressor support 62 which additionally serves to collect condensate dripping from the upper portions of the heat exchanger. Drain bracket 64 serves to provide structural support to compressor support 62 and to direct condensate collected therewithin to drain pan 66. Mounted about the exterior edge of the outdoor section may be seen front guard 80 which prevents air flow into that portion of the center opening of the heat exchanger which is not defined by the fan orifice. It can additionally be seen that screws 48 act to secure both fan orifice 74 and front guard 80 to the appropriate tube supports.

Additionally, it may be seen in FIG. 1 that heat exchanger 20 is made from loops 22 of a wound fin tube wrapped to define a peripherally encasing heat exchanger defining a center opening. It can additionally be seen that the loops are displaced in relation to each other such that each adjacent loop is displaced slightly to provide an overall tapered angle to the heat exchanger. It can be additionally seen that the tapered angle at the top is different from the tapered angle at the bottom although this need not be part of the invention.

Figure 2:
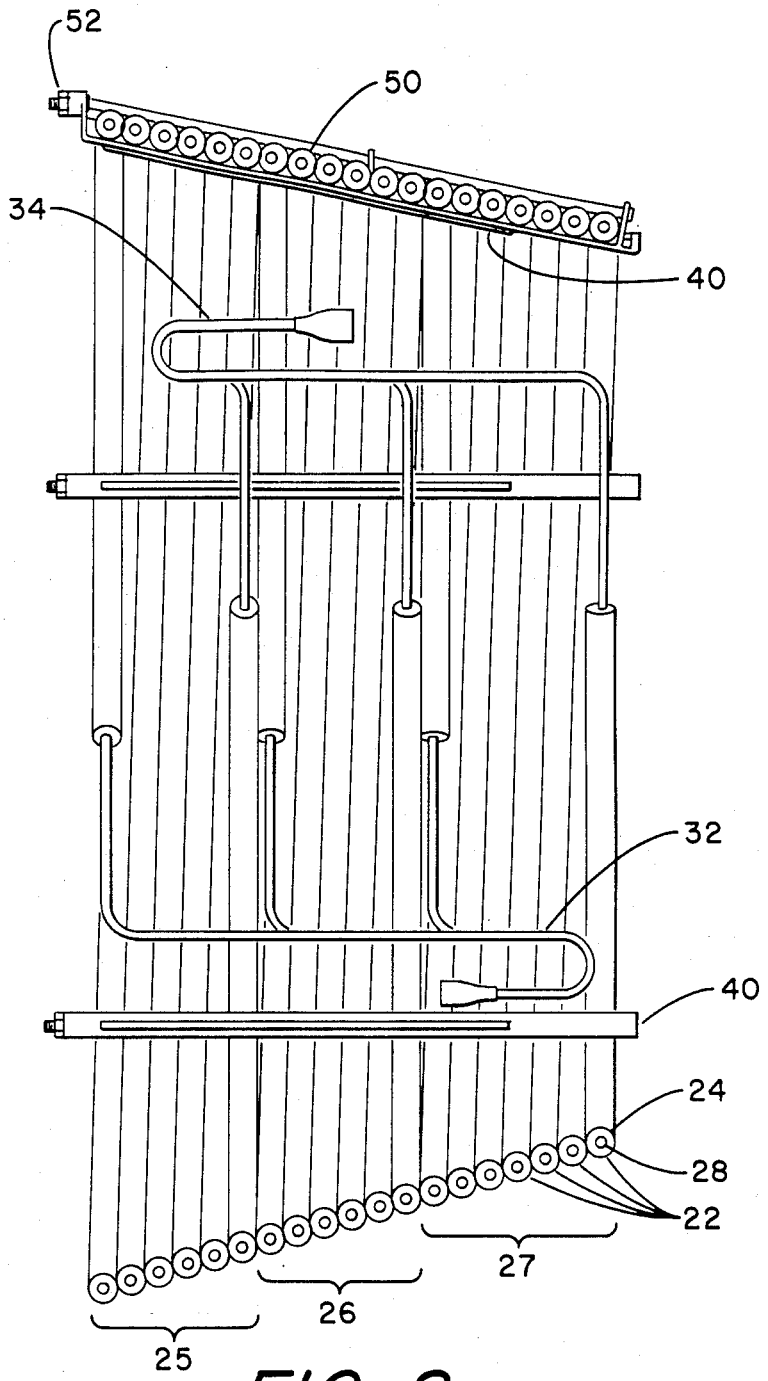
FIG. 2 is a sectional view of the heat exchanger assembly of FIG. 1.

FIG. 2 is a side view of the heat exchanger assembly. Therein it may be seen that the heat exchanger includes three circuits, 25, 26 and 27. Each circuit includes several loops 22 of wound fin tubing. Each loop has base tube 28 and fins 29 wrapped circumferentially or helically about the exterior of the base tube. It can be additionally seen that tube supports 40 are spaced about the heat exchanger. From the view as taken, it can be seen that the heat exchanger is generally rectangular in cross section.

Each of the refrigerant circuits 25, 26 and 27 is connected to both header assembly 34 and header assembly 32 such that the appropriate refrigerant circuiting may be achieved therethrough. Additionally, it may be seen that tube support 40 secures heat exchanger loops between the tube support and rod 50. Again, nut 52 is shown mounted at the end of the tube support for securing the entire heat exchanger and tube support assembly to the partition. The number of loops of tubing in each circuit may be varied to provide the appropriate heat exchange characteristics. Additionally, since the circumference of each loop is different the refrigeration circuit designer has increased flexibility in the tube length selected for each circuit.

Figure 3:
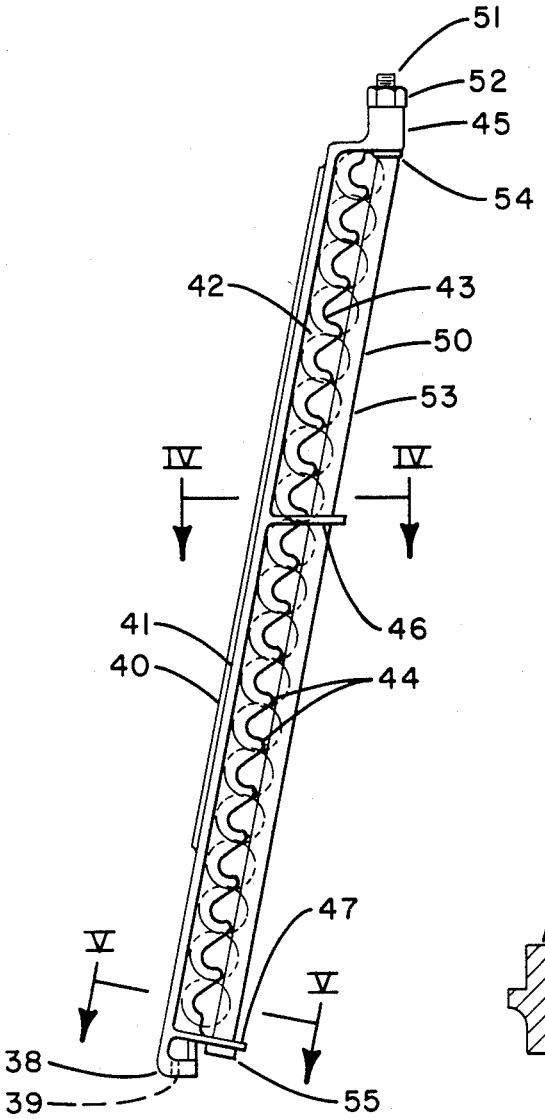
FIG. 3 is a side view of the tube support assembly showing the loops of wound fin tubing secured between the tube support and the rod.

FIG. 3 is an enlarged view of the tube support assembly. The tube support back portion 41 is shown mounted at an angle to the tube support partition end portion 45. As may be seen in the other figures, the partition end portion when mounted is perpendicular to the partition and hence the tube support back portion being at an angle thereto is at an angle to the partition when mounted. Tube support 40 further includes tube securing portion 42 having securing projections 44 which define tube receiving openings 43 wherein the individual loops of wound fin tubing are secured. Middle extension portion 46 extends from the back portion of the tube support at an angle. Extension portion 47 extends from back portion 41 and is perpendicular thereto. Orifice end portion 38 is located at the end of the tube support distant from the partition end portion and further defines a screw opening 39 for the receipt of screw 48 as shown in FIG. 1.

It can additionally be seen in FIG. 3 that rod 50 has a body portion 53 extending the basic length of the tube support and a threaded end portion 51 located at an angle to the body portion and having a threaded portion at the end thereof to which nut 52 may be secured, a cold headed shoulder stop 54 and enlarged diameter end cap 55. It may additionally be seen that partition end portion 45 defines an opening through which the threaded end portion of the rod extends. Furthermore, it may be noted that the tube receiving openings 43 are defined by securing projections 44. The securing projections are not symmetrical but are inclined at an angle to promote the winding of the tube into the projections from an angle perpendicular to the threaded end portion of the rod such that the openings are angled in relation to the angle of the support.

Figure 4:
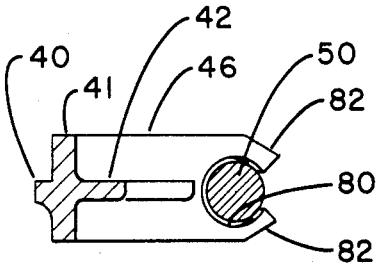
FIG. 4 is a sectional view taken along line IV—IV in FIG. 3 showing the rod slot defined by the extension portion of the tube support.

FIG. 4 is a sectional view of FIG. 3 taken along lines IV—IV. Therein it may be seen that middle extension portion 46 defines rod slot 80. Projections 82 located at the end of extension portion 46 extend inwardly and define a portion of the rod slot, said portion having a diameter less than the diameter of the rod such that when the rod is snapped into position therethrough the projections are displaced outwardly to allow the rod to pass and thereafter return to their original position to secure the rod in position. The tube support 40, back portion 41 and securing portion 42 are also shown in FIG. 4.

Figure 5:
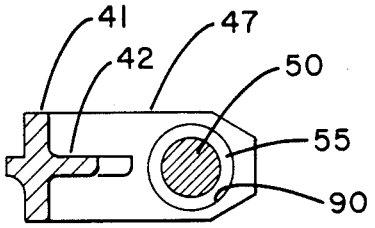
FIG. 5 is a sectional view taken along line V—V in FIG. 3 showing the end extension portion.

FIG. 5 is a sectional view similar to FIG. 4 showing end extension 47. Therein, rod 50 is shown located within opening 90 with end cap 55 engaging extension 47 to limit motion of the rod in one direction. Back portion 41 and securing portion 42 of the tube support are also shown. The clearance shown between rod 50 and opening 90 permits passage of shoulder 54 but stops end cap 55.

Hence, from the above combination it can be seen that the tube support assembly is put together by winding the fin tubing into the tube receiving openings and then inserting the threaded end portion of the rod through the opening defined in the end extension, snapping the rod into position into rod slot 80 and then sliding the rod such that threaded end portion 51 is inserted through the opening in partition end portion 45. In this position, the rod acts to secure the runs of wound fin tubing between the rod and the tube support. It may additionally be seen that threaded end portions are provided such that nut 52 engages the partition to secure the entire assembly. Hence, a heat exchanger assembly and a tube support assembly are provided which allow for easy assembly of components and for a quick snap fit arrangement for securing the tubes in position. Additionally, appropriately angled tube supports are provided for securing a tapered wound fin heat exchanger.

The invention herein has been described with reference to a particular embodiment. It is to be understood by those skilled in the art that variations and modifications can be made within the spirit and scope of the invention.

What is claimed is:

1. A tube support assembly for securing loops of wound fin tubing in an inclined configuration which comprises:

a support member having a partition end portion an opening and a back portion extending at an inclined angle relative to the axis of said opening in said end portion, and at least one extension portion spaced from said partition end portion and defining a rod slot having means to snap fit a rod therein, said partition end portion and said at least one extension portion extending from the same side of said back portion; and tubular support rod sized to extend through the opening in the partition end portion and to snap fit into the rod slot of said at least one extension portion and includes an end portion which extends through the opening in the partition end portion and a body portion angled from the end portion and being generally parallel to the back portion of the support member when snap fit into said rod slot, the loops of tubing being secured between the tubular support rod and the support member.

2. The apparatus as set forth in claim 1 wherein the support member further comprises a tube securing portion having extending securing projections defining angled openings for the receipt of the individual loops of wound fin tubing.

3. The apparatus as set forth in claim 1 wherein said at least one extension portion further comprises coacting projections forming said means to snap fit which partially define the rod slot and which are spaced apart less than the diameter of the tubular support rod.

4. The apparatus as set forth in claim 1 wherein the partition end portion is angled from the back portion of the support member.

5. The apparatus as set forth in claim 4 wherein the tubular support rod end portion is threaded such that the tube support assembly may be mounted to a vertical member via engagement of a fastener with the threaded end portion of the tubular support rod.

6. The apparatus as set forth in claim 4 wherein the tubular support rod further comprises a shoulder extending outwardly therefrom to abut against the partition end portion.

* * * * *